US005503597A

United States Patent [19]

Lochtefeld et al.

[11] Patent Number: 5,503,597

[45] Date of Patent: Apr. 2, 1996

[54] METHOD AND APPARATUS FOR INJECTED WATER CORRIDOR ATTRACTIONS

[76] Inventors: Thomas J. Lochtefeld, 5508 Pacifica Dr., La Jolla, Calif. 92037-7251; Jeffery W. Henry, 305 W. Austin, New Braunfels, Tex. 78130

[21] Appl. No.: 209,449

[22] Filed: Mar. 9, 1994

[51] Int. Cl.[6] ..... A63G 31/00

[52] U.S. Cl. ..... 472/128; 472/117; 4/904

[58] Field of Search ..... 472/117, 128; 239/548, 550, 556, 557, 566; 441/133, 136; 440/38; 104/69, 70, 73, 86; 4/492, 504, 496, 904

[56] References Cited

U.S. PATENT DOCUMENTS

| | | | |
|---|---|---|---|
| 1,648,196 | 11/1927 | Rohmer | 472/117 |
| 3,000,017 | 9/1961 | Skovira | 4/504 X |
| 3,116,925 | 1/1964 | Welch | 441/133 |
| 3,534,413 | 10/1970 | Plasseraud | 4/904 |
| 3,890,655 | 6/1975 | Mathis | 4/904 |
| 3,913,332 | 10/1975 | Forsman | 472/117 X |
| 3,930,450 | 1/1976 | Symons | 104/73 |
| 4,001,899 | 1/1977 | Mathis | 4/904 |
| 4,805,896 | 2/1989 | Moody | 472/117 |
| 4,905,987 | 3/1990 | Frenzi | 472/117 |
| 4,979,679 | 12/1990 | Downs | 239/548 |

FOREIGN PATENT DOCUMENTS

WO9203201 3/1992 WIPO .

*Primary Examiner*—Kien T. Nguyen
*Attorney, Agent, or Firm*—Knobbe, Martens, Olson & Bear

[57] ABSTRACT

A method and apparatus for controllably injecting high velocity jets of water at an elevation at or above water level towards a buoyant object (e.g., a boat or participant in an inner tube) that is floating in a deep water recreation attraction, and causing injected water-to-object momentum transfer and directed buoyant object movement irrespective of the motion of water upon which the buoyant object floats. Structurally, a water conduit is positioned horizontally at or near the surface of a body of water. Adjacent to this conduit is positioned, in parallel corridor like fashion, a second water conduit or a benign retaining structure. The inside width of the corridor is a distance sufficient to permit passage of the buoyant object. An array of water injectors is aligned on the inside of the conduit-formed-corridor at an elevation at or above water level. These injectors are uniformly pointed at the opposing water conduit (or benign retaining structure) at an angle to the desired direction of buoyant object travel. A water source pressurizes the conduit(s) and causes the injectors to generate a power grid of jetted water along the inside length of the corridor. Spacing between injectors and water pressure per injector is sufficient to cause a buoyant object that floats inside the corridor (e.g., a participant in an inner tube), to be propelled by each successive jet down the length of the corridor. The corridor can also be used to drive buoyant objects out of a deep-water environment and up onto a beach or other water ride attraction.

32 Claims, 7 Drawing Sheets

22
24
25
22
24
29
26
27
21
23
28
55
21a

METHOD AND APPARATUS FOR INJECTED WATER CORRIDOR ATTRACTIONS

FIELD OF THE INVENTION

The present invention relates in general to water rides, specifically a mechanism and process that safely transfers the kinetic energy of jetted water from an array of injectors to participants or vessels floating along a deep water corridor. This injected water corridor attraction will allow participants or vessels: (1) to accelerate or maintain a constant velocity along the corridor; and (2) to be propelled out of the deep water corridor onto a beach or up a transition ramp to enter another water ride.

BACKGROUND OF THE INVENTION

In the water recreation industry (waterparks, resorts, municipal pools and aquatic centers), there are numerous water associated attractions, including waterslides, white water rapids, and flume boat rides, that utilize water to transport participants along a predetermined path. Many of these rides, however, are gravity induced, i.e., they begin at high elevation and end at low elevation. The disadvantage of gravity induced rides is that the necessary elevated topography is costly to construct (especially on flat ground). Participants must also move from a low elevation point to a high elevation point to enter the ride. Another disadvantage is that gravity induced rides are generally limited to a relatively short ride participation time. An average commercial water slide, for example, has a ride duration of approximately 30 seconds. It is desirable, therefore, to develop a water ride that can function with minimal change in topography, at a minimal capital cost and for an extended ride duration.

One ride attraction commonly found in water theme parks that overcomes these disadvantages is the "lazy river." The lazy river is a pool of water fashioned in a circuitous loop around a central island(s). A central feature of the lazy river is the containment pool. The containment pool is relatively deep (approximately one meter) and contains a substantial mass of water. As a driving mechanism, the lazy river uses a system of ducts positioned below water level to discharge a stream of water through nozzles located on either the floor or side walls of the river. Momentum transfer between the discharge water and the pooled water causes the entire body of pooled water to flow in river-like fashion and in turn transport participants floating on the river's surface. Because the lazy river is circuitous, a participant can ride in the lazy river for an extended period.

While the lazy river can be built on level ground and has extended user participation time, one disadvantage of the lazy river is that it is relatively slow moving and does not provide the high-speed thrills of other gravity induced rides. To overcome this disadvantage, a combination of high speed water rides and slow-moving, circuitous river loops was disclosed in an "action river" as described more fully in application Ser. No. 08/065,467, which is incorporated herein by reference. The action river is distinguishable from the lazy river in that it is connected to one or more adjacent water rides, such as a Flow Rider™, which empowers the circuitous flow of water in the river. In the action river, participants can exit a fast-moving water ride, e.g., Flow Rider™, directly into a slow moving circuitous river and can ride in the river while waiting to enter directly into another adjacent water ride.

Another such adjacent water ride contemplated for use with the action river is a class of water attraction rides recently introduced to the theme park market as the Master Blaster™, such as the kind described more fully in U.S. Pat. No. 5,213,547, which is incorporated herein by reference. This attraction injects a high velocity water flow onto a ride surface to cause a rider (or vehicle) to move along the ride surface at high speeds by direct water-to-rider momentum transfer. The Master Blaster™ can be interconnected to the action river so that a participant may ride or float in the action river and enter directly into the Master Blaster™ without having to exit the river. The Master Blaster™ also can be interconnected to the action river so that a participant can exit directly back into the action river.

A problem not fully addressed in the "action river" combination water ride system is how a participant makes the transition or exit from a "deep," relatively slow-moving mass of water, such as that found in the "action river," to enter directly onto an adjacent "shallow," fast moving water ride such as the Master Blaster™. The present invention overcomes this problem and relates to a transition apparatus, which can be used to move participants from a deep-water environment to a shallow-water environment, and vice versa, and which can be used as a water ride on its own.

SUMMARY OF THE INVENTION

The primary objective of the present invention is to provide a safe, entertaining and functional water ride in which objects, participants or vessels floating in a deep-water environment can be propelled by surface level water injection without regard to the direction of motion of water upon which the object/participant/vessel is floating.

The present invention comprises a corridor formed by one or more conduits having a number of water injection nozzles positioned at or above the surface of a relatively deep body of water. The conduits are positioned adjacent the surface of the body of water, or can be made to float thereon, so that they form a surface corridor or other passageway as will be discussed. The nozzles on the conduits are positioned such that they inject water at or above the level of the body of water in a predetermined direction, i.e., in the direction in which the object/participant/vessel is to flow, which can be with, across or against the flow of water in the body of water. While the body of water can be still, or can travel in a predetermined direction about the pooled container, the corridor can divert surface water, and any objects/participants/vessels floating thereon, in a different direction.

Rather than speeding up the entire mass of water in the containment pool, which can consume substantial amounts of energy, the present invention injects water only at or above surface level at relatively high velocities so that the objects/participants/vessels floating on the body of water can be accelerated in a direction which can be with, across or even against the main flow of the body of water. In this way, the participant can be accelerated through the body of water without having to accelerate the entire mass of water.

The advantages of such an attraction are numerous. First, the present invention can be used as a separate water ride or transport corridor within a body of still water, e.g., lakes and conventional swimming pools. Such a corridor can advantageously simulate a river like flow without the need of erecting costly containment channels as found in typical lazy/action river attractions. In addition, traditional lake activities can still take place outside the water corridor while using the corridor to transport participants from one location to another. Alternatively, this water corridor can be used to transport ride vessels (boats, floatables or inflatables) to other parts of the lake where needed.

Second, the present invention can be used in conjunction with a moving body of water, such as a natural river or a theme park lazy/action river. The corridor in such applications can accelerate floating participants downstream in excess of the speed of flow of the body of water. In addition, the corridor can be used to transport participants across-stream, or even back upstream counter to the direction of flow. In this fashion, users can float downstream in the moving body of water with the current, and can then enter the corridor to move across-stream or upstream toward an exit point or an entrance to an adjacent water ride, e.g., Master Blaster™. Alternatively, this water corridor can be used to transport participants and ride vessels, e.g., boats or inflatables, back to an original starting point.

Third, the water corridor can be used in the splashdown area of an adjacent water ride, e.g., Master Blaster™, to safely and quickly move participants away from the splashdown area. The water corridor when installed into a splash down area of a water ride can improve safety by quickly transporting the splash down participant out of the impact zone and away from a subsequent splash down participant. Accordingly, the overall capacity and throughput of the adjacent water ride can be substantially increased, thus heightening user enjoyment and ride satisfaction.

Another advantage of the water corridor is its relatively low installation cost. In a lazy/action river embodiment, a circuitous containment pool must be built with side walls and a floor. Once built, these flow containment walls and floors are difficult to modify and the specific design purpose of the circuitous loop does not lend itself to multiple aquatic uses. On the other hand, the present invention can: (1) simulate a river-like flow (without requiring expensive containment walls and floors); and (2) be readily modified to permit multiple aquatic uses. Because the corridor can be made to float on the surface of an existing body of water, and only consists of conduits which inject water at or above the level of the body of water, i.e., has no actual "ride surface," the present invention is inexpensive to install, maintain and operate. The corridor is also relatively portable in that it can be moved rather easily.

Moving a body of water upon which a participant floats can be disadvantageously expensive, especially if the water body is extremely large. To move a participant across-stream or counter to the direction of deep water motion is a feature not found in lazy and action rivers, i.e., the general direction of river motion is typically limited to the direction of mass transport parallel to the river containment walls. Furthermore, movement of participants in a body of water from one water attraction to another water attraction is typically done by moving the entire mass of water, in which the destination must be limited to attractions located downstream. It is desirable, therefore, to develop a water ride that can: (1) move a floating object without moving the mass of water upon which the object floats; (2) move a floating object cross stream or in a direction opposite to the direction of water upon which the object floats; and (3) move a floating object to another water attraction that is at an elevation higher than the river water level.

Positioning of the water injector nozzles at or above the water line results in direct momentum transfer to any object, participant or vessel floating in the corridor. The specific placement of injector nozzles, whether at or above water level, depends upon the size and shape of the floatation vehicles being used. Above water level injections can directly contact the object/participant/vessel and provide maximum efficiency in transferring momentum from the water injection to the object/participant/vessel. Direct momentum transfer avoids the necessity of having to move surface water in order to move the object/participant/vessel floating on the surface, and advantageously minimizes the energy required to effect participant movement. By placing injection nozzles at water level, on the other hand, momentum transfer must occur via movement of the water at surface level. This application may be advantageous where direct contact with the injected water is not desirable, or where the corridor is relatively wide such that direct injection would not effectively contact each object in the corridor.

Another distinct advantage of the present invention is that the water injected corridor is modular and of minimal bulk. Consequently, the corridor can be quickly and inexpensively moved as desired. Ease of assembly and disassembly allows a swimming pool outfitted with the present invention to function at one time for competitive swimming events (with the corridor pushed to one side), and at another time to serve as a general recreation pool with the corridor in place simulating a lazy river.

Since the water injected corridor floats, it requires no direct connection to the bottom of the water body in which it is located. This bottom "independence" is advantageous in avoiding environmental damage in ecologically sensitive areas, e.g., natural lakes and rivers. Such avoidance will permit recreation attraction development in locations previously unavailable. A floating water corridor in a lake environment also advantageously adjusts to changing lake levels.

Other objectives and advantages will be apparent from the following description taken in conjunction with the drawings included herewith.

DETAILED DESCRIPTION OF PRESENT INVENTION

To facilitate a concise description of the multiplicity of embodiments set forth in this invention, and to avoid burdensome repetition, a modular approach has been taken to define a set of common elements that are central to each embodiment. The module is only grouped for purposes of convenience and is not intended to limit the scope of the invention, or the structure or function of the respective components that comprise the module. Furthermore, the size and relationship of the components that comprise a module is a function of intended use. To facilitate description of this invention, the preferred attraction structure and operation will be defined in terms of its impact on a single user floating on an inner tube. However, it is understood by those schooled in the art that with proper sizing the subject invention could also function to propel ride vehicles, or conversely, with suitable adjustment for height, width, weight, hull displacement, friction and surface shape, the subject invention could service multi-passenger boats or inflatables.

Figure 1:
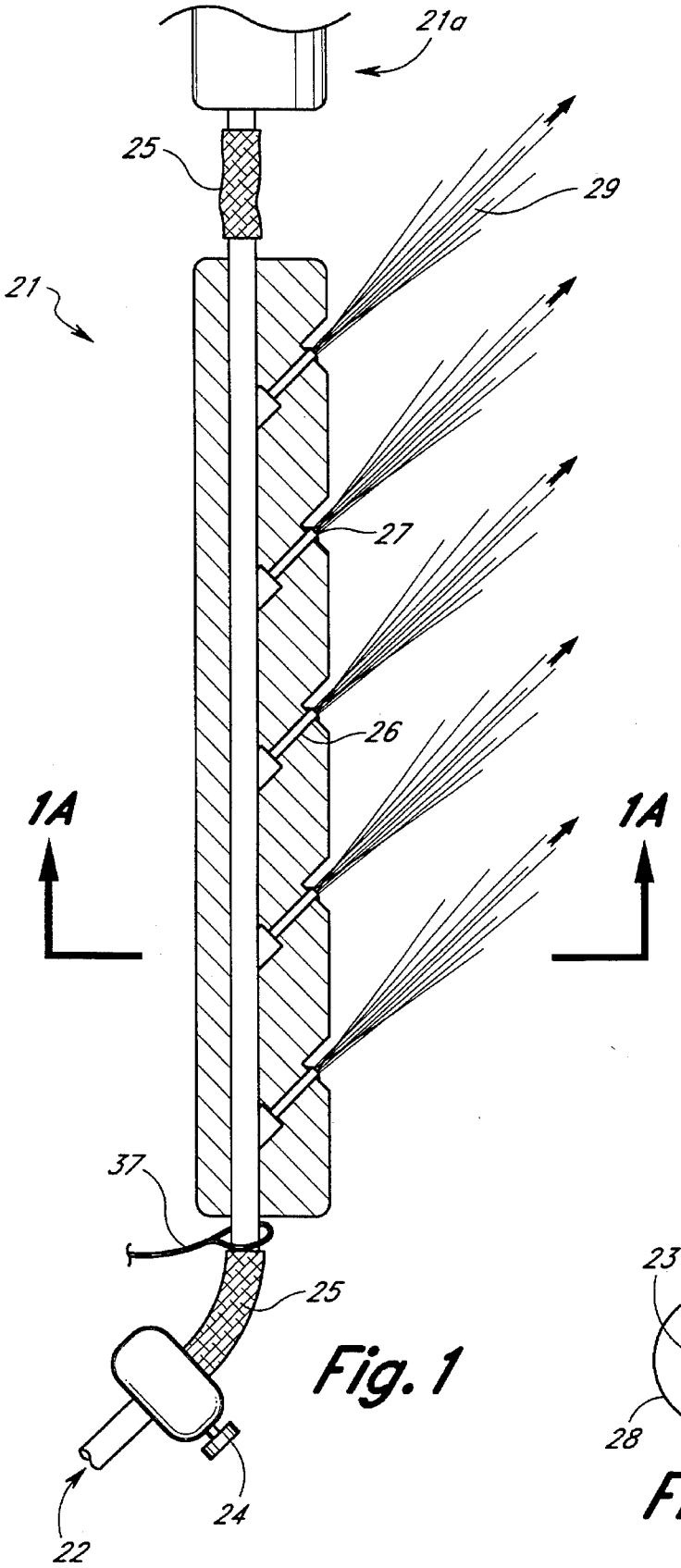
FIG. 1 is a top view of a propulsion conduit module.
Figure 1A:
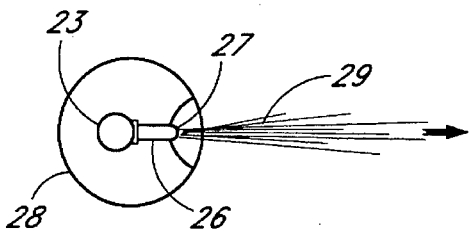
FIG. 1A is a cross section of a propulsion conduit module taken along 1A—1A in FIG. 1.

Turning now to FIG. 1 (top view) and FIG. 1A (cross-section), there is illustrated a propulsion conduit module 21 comprised of a high flow/pressure water source 22 (with arrow indicating the direction of flow); a central pipe manifold 23; a module coupling 25; an array of jet forming nozzles 26; and a discrete jetted water discharge 29 with arrow indicating the predetermined direction of motion issuing from jet forming nozzles 26. The relative angle and attitude of jet forming nozzles 26 and the corresponding direction of jetted water discharge 29 may vary depending upon intended use as indicated in alternate embodiments discussed herein.

Figure 2A:
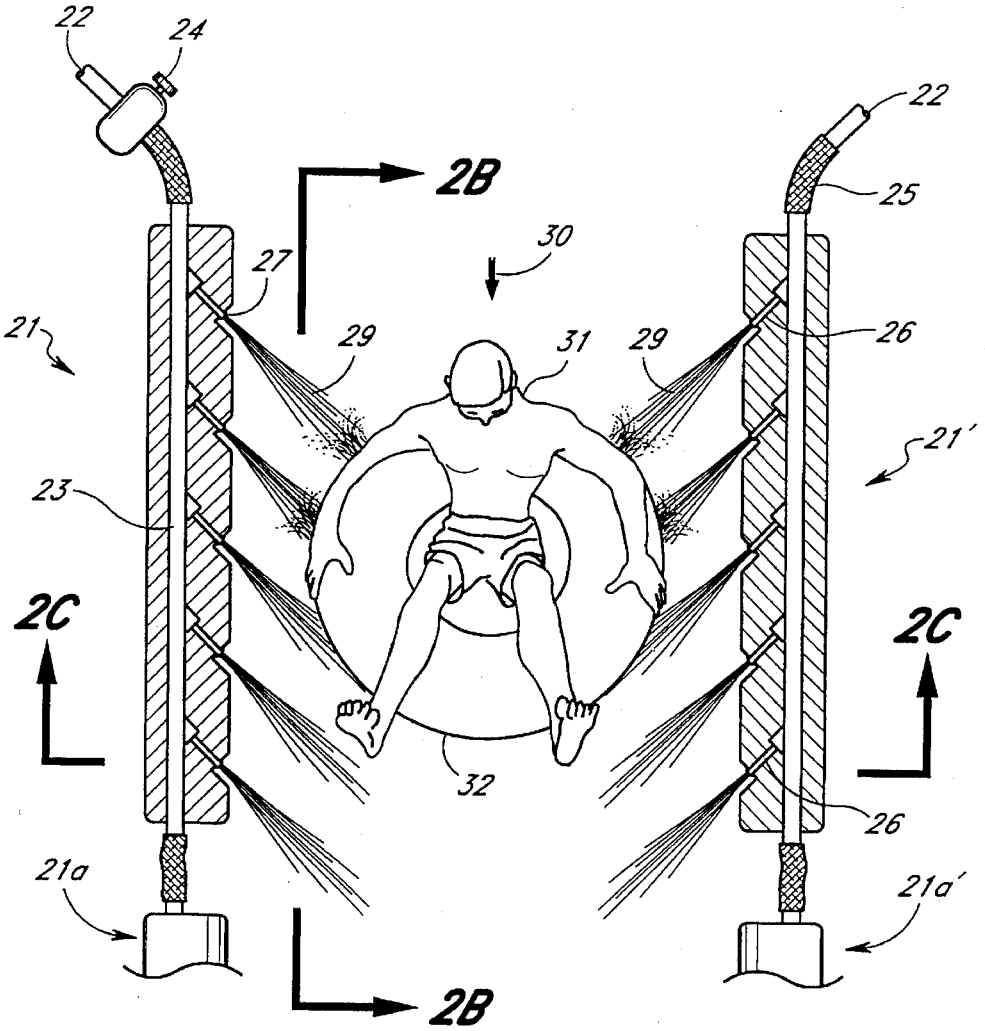
FIG. 2A is a top view of a bilateral water corridor in operation.
Figure 2B:
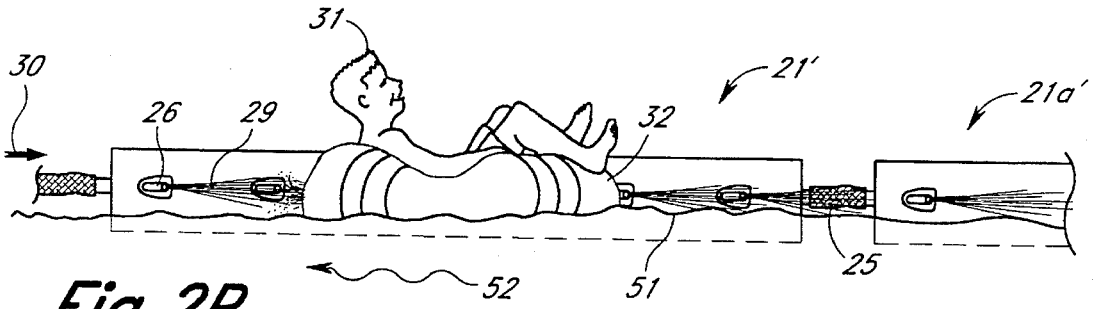
FIG. 2B is a side view of a bilateral water corridor taken along 2B—2B in FIG. 2A.
Figure 2C:
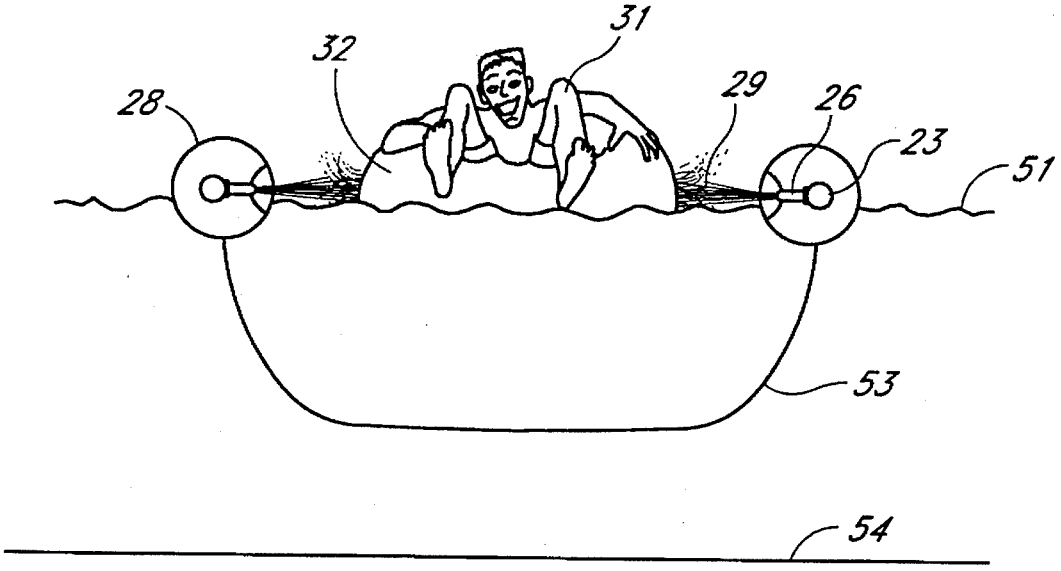
FIG. 2C is a cross-section of a bilateral water corridor taken along 2C—2C in FIG. 2A.

Optional enhancements to propulsion conduit module 21 include: a main control valve 24 which allows gross adjustment of flow to central pipe manifold 23 and resultant gross adjustment to the array offered water discharge 29; and adjustable aperture 27 which permits fine flow adjustment for each individual jet forming nozzle 26; a tether 37 which affixes module 21 to either a dock, pool wall or like/river bosom in a secure position; a jacket 28 which serves to buoy the entire propulsion conduit module 21 and/or functions is a protective bumper in the event of contact with participants or ride vehicles; and a protective sub-surface safety liner 53 (see FIG. 2C). Although not illustrated, module 21 can be slightly curved to enable water conduit bends and turns.

Propulsion module 21 is connected by module coupling 25 to other modules (e.g., 21*a*) in end-to-end relation. Coupling 25 can result from bolting, gluing, or thread, or other similar means. Module coupling 25 is preferably made from a flexible rubber or plastic hose or PVC type material. Central pipe manifold 23, main control valve 24, jet forming nozzles 26 and adjustable apertures 27 are preferably made from lightweight plastic, although fiberglass or metal can be used in demanding environments. Jacket 28 is preferably made from either inflatable fabric or plastic material, or closed cell foam (to minimize water absorption) and coated with a soft plastic (e.g., urethane coating) to enhance user safety and further retard water absorption. For added user protection, jet forming nozzle 26 are recessed within jacket 28 to minimize user contact.

Tether 37 is preferably made from stainless cable, coated chain, or rope firmly attached to module 21 and anchored as site conditions permit. Alternatively, in the event module 21 does not float, tether 37 could also serve as a structural support to maintain module 21 at the proper surface operating level. In this later instance, tether 37 composition could be metal pipe, wood, reinforced plastic or some other suitable structural member embedded in proper foundation. The number of tethers required to properly secure a chain of modules is a function of overall attraction specification, layout and site condition. On the one hand, where a water corridor is positioned free-standing in the middle of a river, and where the desired object of propulsion is massive and requires a large jetted water discharge force in order to effect movement, then tethers need sufficient number and strength to counterbalance the corollary relative forces. On the other hand, where a water corridor is secured from one side of a swimming pool to another, then tether anchors at each respective end wall is sufficient. Subsurface safety liner 53, which can support a user in deep water to prevent drownings, is preferably made from a flexible plastic sheet, or in the alternative, a netting would suffice. Subsurface safety liner must be sufficiently strong to withstand participant weight and movement in the event a nonswimmer uses the liner as a means of support while in a deep-water environment.

The length of module 21 can vary, depending on desired operational performance characteristics and desired construction techniques or shipping parameters. The width of module 21 can be as narrow as will permit one participant to ride on a floatable vessel in a seated or prone position with legs aligned with the direction of water flow [roughly 0.5 meters (20 inches)], and as wide as will permit multiple participants to simultaneously ride abreast or a passenger vehicle to function.

The driving mechanism which generates the water pressure for the water source 22 can either be a pump or an elevated reservoir. Where a series of modules are connected, a single high pressure source or pump with a properly designed manifold could provide the requisite service, or in the alternative, a separate pump for each module could be configured. The line size of the water source 22 need be of sufficient capacity to permit the requisite configuration and pressure of jet-water flow 29 to issue from nozzle 26.

Nozzle 26 dimensions are a function of available water flow and pressure and the desired performance and capacity characteristics of the module, as further described herein. Aperture 27 of nozzle 26 can either be fixed or adjustable. The preferred embodiment uses an aperture capable of adjustment. Ideally, adjustment should allow for variations in thickness and width of jetted discharge water 29. For example, but not by way of limitation, the width and breadth of nozzle aperture 26 can range from ½ cm to 40 cm. A multiplicity of adjustment devices are capable of effecting proper aperture control; e.g., screw- or bolt-fastened plates, welded plates, valves, movable weirs, or slots, etc. Many of such devices are capable of automatic remote control and programming. For example, it is possible to install motion detectors (not shown) and solenoids (not shown) to sequence the timing of jetted water discharge 29 to correspond with a given participant's position, thus minimizing the amount of water and energy used to drive the participant along the corridor. The water pressure at nozzle aperture 26 can vary, depending upon desired operational characteristics. In a single participant waterslide setting, nozzle pressure can range from approximately 5 psi to 250 psi, depending upon the following factors: (1) size and configuration of nozzle opening; (2) the weight of the rider; (3) the direction or turbulence of subsurface flow; (4) the choppiness of surface water; (5) the physical orientation of the rider/vehicle relative to the jelled water; (6) the angle of incline, rise in elevation, and surface friction of a given deep-water-to-shallow-water transition ramp; and (7) the desired increase or decrease in speed of the rider due to flow-to-rider kinetic energy transfer. In a single rider/object application, the preferred pressure is between 15 psi to 25 psi. In a water ride attraction that utilizes vehicles, nozzle pressure range can be higher given that vehicles can be designed to withstand higher pressures than the human body and can be configured for greater efficiency in kinetic energy transfer.

The main control valve 24 and adjustable aperture 27 are used to regulate pressure and flow as operational parameters dictate and can be remotely controlled and programmed. In general, to enable continuity in rider throughput and water flow, when modules are connected in series for a given attraction, all nozzles should be aligned in the same relative direction to augment rider movement; however, an exception may occur when changing rider direction.

With the exception of transition from deep water to shallow water (see discussion, infra), the water corridor module 21, as described herein, is intended for a deep-water environment; i.e., with a depth of water sufficient to float boats, inner tubes, or any other vessel (with or without participants). From practical experience this depth is in excess of 20 cm. The participants or vessels floating in this deep-water environment are propelled by impact from jetted water 29 and the resultant momentum transfer. Of consequence, the resultant direction of motion imparted to the desired object of travel by water corridor module 21 is without regard to the direction of motion of subsurface water upon which the object/participant/vessel is floating.

The condition of all water (i.e., temperature, turbidity, pH, residual chlorine count, salinity, etc.) disclosed herein is standard pool, lake, or ocean condition water suitable for human contact.

Description of Bilateral Water Corridor

FIG. 2A illustrates in plan view a bilateral water corridor 30 (with indicator arrow pointing in the direction of desired movement in the corridor), wherein four propulsion conduit modules 21, 21', 21*a*, 21*a'* are aligned in parallel with jet-forming nozzles 26 pointed at the opposing array. Any floating object/participant/vessel is propelled down the center of bilateral water corridor 30 by jetted water 29 that discharges from jet-forming nozzles 26. From this plan perspective (viewed from above) along straight sections of run, jet-forming nozzles 26 are preferably positioned to direct jelled water 29 at a 22-degree angle from the longitudinal axis of central pipe manifold 23, although the angle can be higher (as shown) or lower. At higher degrees of angle, the component of propulsive force in the desired direction of travel is diminished. However, there are certain situations, e.g., when the corridor is wider than the object floating therein, or, when causing floating objects to negotiate a bend in the bilateral corridor, where injection of jetted water 29 at angles in excess of 22 degrees from the longitudinal axis of central pipe manifold 23 is functionally appropriate. In this later instance, the desired direction of travel is changing; hence, the preferred angle may change to accommodate the preferred vector of travel.

Conversely, at smaller angles and with all other factors equal, jelled water 29 must travel a longer distance to effect impact and momentum transfer. Increased distance and its corollary of increased travel time may permit the downward force of gravity to adversely affect the trajectory of jetted flow, the angle of impact of jetted water 29 on the desired object of propulsion, and the resultant component of propulsive force in the desired direction of travel. Distance notwithstanding, at times a reduced angle of injection may be desired. In these instances an increase in the velocity of jetted water 29 can solve the aforementioned distance disadvantage.

When viewed from the side (see FIG. 2B), the determination of the proper position for jet-forming nozzles 26 is a function of the desired object of momentum transfer. Variations in the size of the desired object of momentum transfer, e.g., a large boat/raft, or variations in the operating elevation of jet-forming nozzle 26 relative to a static water level 51, upon which the desired object of momentum is floating, will affect the preferred horizontal plane position of jet-forming nozzle 26. However, as a general rule it is preferred to position jet-forming nozzle 26 with jetted water 29 directed to hit the expected above-water center of mass of the desired object of momentum transfer. For example, in the situation of rider 31 floating an inner tube 32 as illustrated in cross section by FIG. 2B, it is preferred that the nozzle is directed either at the centerline of the inner tube (indicated by dashed line) or the above-water center of mass of rider 31.

The beginning and end of bilateral water corridor 30 can be joined to known water attraction rides (e.g., a standard waterslide or flume ride) to serve as a continuation thereof and as an improvement thereto. Likewise, the beginning and end of bilateral water corridor 30 can also be joined to other embodiments of the invention disclosed herein.

Operation of Bilateral Water Corridor

Rider 31 first enters bilateral water corridor 30 at an open end upstream from jetted water discharge 29 and moves along the length of the corridor, as shown in FIG. 2A and FIG. 2B. Jetted water discharge 29 originating from water source 22 issues from jet-forming nozzle 26 when rider 31 enters its flow. Since the velocity of jetted water discharge 29 is moving at a rate greater than the speed of the entering rider 31, a transfer of momentum from the higher-speed water to the lower-speed rider causes the rider to accelerate and approach the speed of the more rapidly moving water. Main control valve 24 and adjustable aperture 27 permits adjustment to water flow velocity, thickness, width, and pressure, thus ensuring proper rider acceleration. Since bilateral water corridor 30 can be comprised of one or more modules 21, 21', 21*a*, 21*a'*, et seq. (as shown in FIG. 2A), and assuming these modules are properly aligned in substantially the same direction, rider 31 can move from modular pair 21 and 21' to modular pair 21*a* and 21*a'*, et seq. It is also possible to cause a corresponding increase in acceleration caused by the progressive increase in water velocity issued from each subsequent modular pair until a desired maximum acceleration is reached. Increased acceleration can be advantageous when transporting a rider or vehicle from a deep-water environment to a shallow-water environment; e.g., a beach or a Master Blaster™. Of particular note, FIG. 2B shows rider 31 propelled by above-surface jetted water discharge 29 and moving in bilateral water corridor 30 (with indicator arrow pointing in the direction of movement) without regard to the direction of motion of a subsurface water current 52 (as indicated by undulating arrows) upon which rider 31 within inner tube 32 is floating. It will be obvious to those skilled in the art that the bilateral wall corridor can be connected at both ends to known water attraction rides as a continuation thereof and as an improvement thereto. Furthermore, the extreme ends can also be joined to other embodiments of the invention disclosed herein.

FIG. 2C shows in cross section bilateral water corridor 30 with subsurface safety liner 53 attached. Liner 53 serves to support rider 31 in the event he is unable to swim and should fall out of his inner tube. Liner 53 would be of particular importance in a deep-water environment where a bottom 54 is at a depth in excess of the height of rider 31. In this event, to provide an added measure of safety, liner 53 could run the length of bilateral water corridor 30.

From the description above, a number of advantages of bilateral water corridor 30 becomes evident:

(a) Contrary to conventional attractions, the horizontal layout of the bilateral water corridor embodiment eliminates the need for a loss of elevation in order to move a participant over a given distance.

(b) The sight, sound, and sensation of horizontal movement induced by high speed jets of water impacting a rider or vehicle is an exciting participant and observer experience.

(c) Capital cost for a bilateral water corridor embodiment is substantially less than traditional hard wall/floor channel construction used in a typical lazy river analog.

(d) The modular nature of the bilateral water corridor permits flexibility in size and location to accommodate multiple aquatic uses in a single pool.

(e) The bilateral water corridor can propel, by above-surface water injection objects, participants, or vessels floating in a deep-water environment without regard to the direction of motion of water upon which the object/participant/vessel is floating. Of consequence, the present invention could accelerate floating participants downstream in excess of the speed of flow, or move participants cross-stream to adjust their side-to-side position, or even more participants back upstream counter to the direction of flow.

Description of Parallel Unilateral Water Corridor

Figure 3:
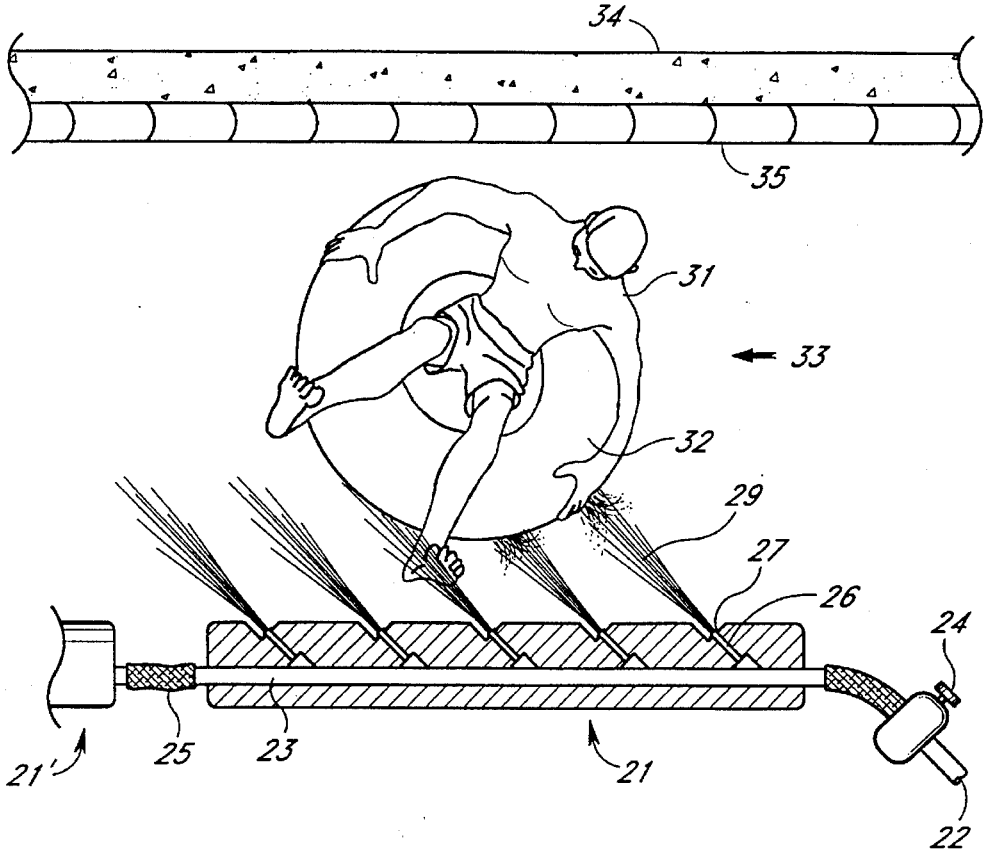
FIG. 3 is a top view of a parallel unilateral water corridor.

FIG. 3 illustrates in plan view a parallel unilateral water corridor 33 (with indicator arrow pointing in the direction of desired movement in the corridor), wherein a single propulsion conduit module 21 is positioned parallel to a benign retaining structure 34. Benign retaining structure 34 can either be a pool wall or floating bulkhead; e.g., a dock or pipe. Optionally, benign retaining structure 34 is padded with a bumper 35 to enhance rider safety and minimize vehicle abrasion. Similar to bilateral water corridor 30, it is preferred to fix jet-forming nozzles 26 with jetted water 29 directed at the above-water center of mass of the desired objection of momentum transfer. However, due to single-sided injection, the cross-stream force component causes rider 31 to move towards and roll against the benign retaining structure 34. To compensate for this asymmetric power drive and to further movement down the corridor, it is preferred that in parallel unilateral water corridor 33, jet-forming nozzles 26 (when viewed from above) are positioned to direct jetted water 29 at an 11-degree angle from the longitudinal axis of central pipe manifold 23, although the angle can be higher (as shown) or lower. Variations from the preferred angle of propulsion are subject to the same trade-offs as previously discussed. Consequently, with other factors equal, this decrease in angle (as compared to the bilateral water corridor layout) may require additional jetted water velocity to compensate for the increase in distance travelled by the jetted water before impact and desired momentum transfer.

The beginning and end of parallel unilateral water corridor 33 can be joined to known water attraction rides (e.g., a standard waterslide or flume ride) to serve as a continuation thereof and as an improvement thereto. Likewise, the beginning and end of parallel unilateral water corridor 33 can also be joined to other embodiments of the invention disclosed herein.

In addition to those described in the bilateral water corridor, a number of advantages of parallel unilateral water corridor 33 become evident:

(a) Use of benign retaining structure 34 cuts in half the required number of propulsion modules 21.

(b) Existing pools can be retrofitted with parallel unilateral water corridor 33 and make use of their existing pool walls to serve as benign retaining structures 34.

Operation of Parallel Unilateral Water Corridor

As illustrated in FIG. 3, rider 31 on inner tube 32 first enters parallel unilateral water corridor 33 at an open end upstream from jetted water discharge 29 and moves in a direction (as indicated by arrow) parallel to both module 21 and benign retaining structure 34. Jetted water discharge 29 originating from water source 22 is already issuing from jet-forming nozzle 26 when rider 31 enters its flow. Since the velocity of jetted water discharge 29 is moving at a rate greater than the speed of the entering rider 31, a transfer of momentum from the higher-speed water to the lower-speed rider causes the rider to accelerate and approach the speed of the more rapidly moving water. Main control valve 24 and adjustable aperture 27 permits adjustment to water flow velocity, thickness, width, and pressure, thus ensuring proper rider acceleration. Since parallel unilateral water corridor 33 can be comprised of one or more modules 21 and 21', et seq. (as shown in FIG. 3), and assuming these modules are properly aligned in substantially the same direction, rider 31 can move from module 21 to module 21', et seq. It is also possible to cause a corresponding increase in acceleration caused by the progressive increase in water velocity issued from each subsequent module 21 until a desired maximum acceleration is reached. Increased acceleration can be advantageous when transporting a rider or vehicle from a deep-water environment to a shallow-water environment; e.g., a beach or a Master Blaster™. It will be obvious to those skilled in the art that parallel unilateral water corridor 33 can be connected at both ends to known water attraction rides as a continuation thereof and as an improvement thereto. Furthermore, the extreme ends can also be joined to other embodiments of the invention disclosed herein.

Description of Turning Corridor

Figure 4A:
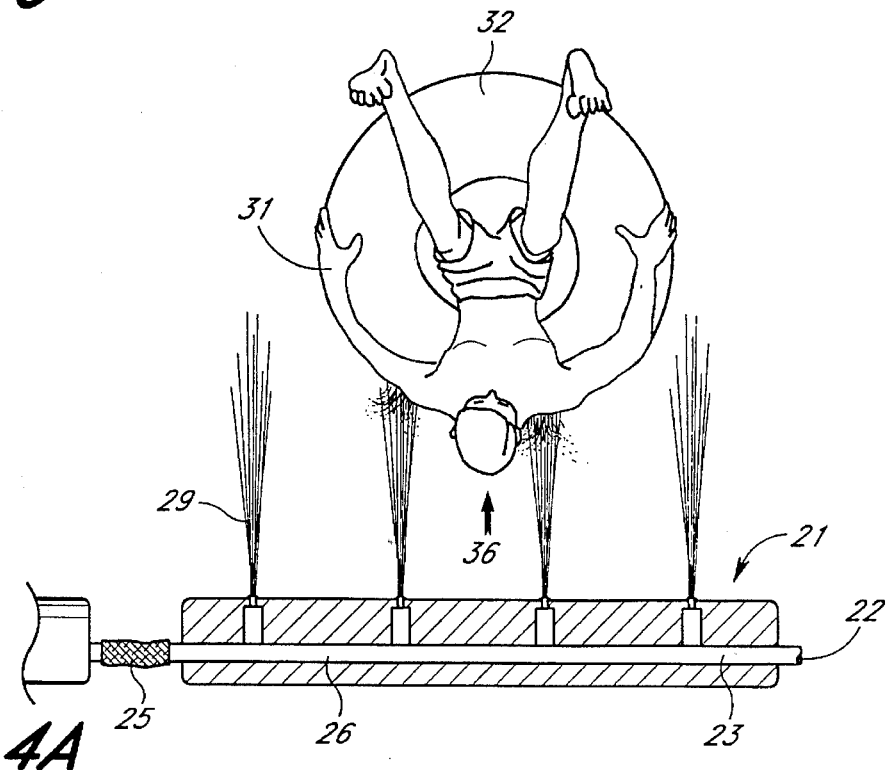
FIG. 4A is a top view of a straight turning corridor.

FIG. 4A illustrates in plan view a straight turning corridor 36 (with indicator arrow pointing out the prospective changes of direction and ultimate downstream movement). As pictured, jet-forming nozzles 26 are arranged at a 90-degree angle to central pipe manifold 23 to cause jetted water 29 to shoot in a direction perpendicular to module 21. Variations from a 90-degree angle are a function of desired rider or vehicle directional changes. Similar to the previous water corridor embodiments, it is preferred to fix jet-forming nozzles 26 with jetted water 29 directed at the above-water center of mass of the desired object of momentum transfer. Straight turning corridor 36 is distinguished from bilateral water corridor 30 and parallel unilateral water corridor 33 in that it is not required to have an opposing structure in order to function.

Figure 4B:
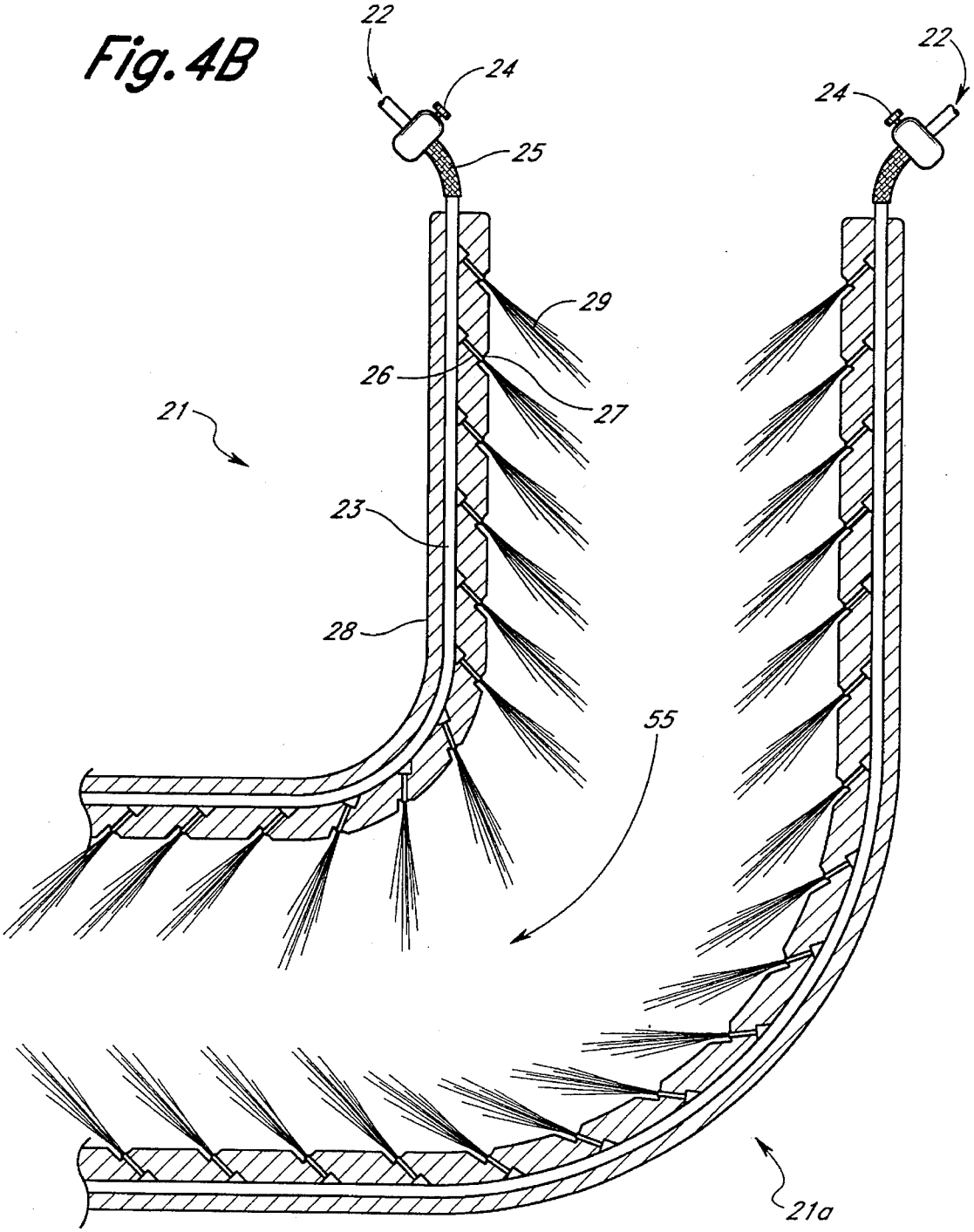
FIG. 4B is a top view of a curved turning corridor.

FIG. 4B illustrates in plan view a curved turning corridor 55 (with indicator arrow pointing out the prospective change of direction and ultimate downstream movement). As pictured, jet forming nozzles 26 are arranged at varying angles to central pipe manifold 23 with a common purpose of propelling a rider or object down the middle of the corridor. Similar to the previous water corridor embodiments, it is preferred to fix jet forming nozzles 26 with jetted water 29 directed at the above water center-of-mass of the desired object of momentum transfer.

Operation of Turning Corridor

As illustrated in FIG. 4A, rider 31 on inner tube 32 enters straight turning corridor 36 from either open side directly into jetted water discharge 29. The velocity of jetted water discharge 29 is moving at a rate greater than the speed of the entering rider 31 and in a direction that is perpendicular to central pipe manifold 23. A transfer of momentum from jetted water discharge 29 to rider 31 causes rider 31 to change direction and move away from module 21. Main control valve 24 and adjustable aperture 27 permits adjustment to water flow velocity, thickness, width, and pressure, thus ensuring proper rider directional change.

As illustrated in FIG. 4B a rider or object (not pictured) enters curved turning corridor 55 at an open end which is upstream from jetted water discharge 29 and moves along its length. Jetted water discharge 29 originating from water source 22 through central pipe manifold 23, is already issuing from jet forming nozzle 26 when the rider or object enters its flow. Since the velocity of jetted water discharge 29 is moving at a rate greater than the speed of the entering rider or object, a transfer of momentum from the higher speed water to the lower speed rider/object causes the rider/object to accelerate and approach the speed of the more rapidly moving water. Main control valve 24 and adjustable aperture 27 permits adjustment to water flow velocity, thickness, width, and pressure thus ensuring proper rider/object acceleration. Since curved turning corridor 55 is comprised of modules 21 and 21*a*, and assuming these modules are properly connected by couple 25 to another downstream modular pair (not shown), then, a rider/object can move from modular pair to modular pair along a changing direction of flow. It is also possible to cause a corresponding increase in water velocity issued from each subsequent modular pair until a desired maximum acceleration is reached. Increased acceleration can be advantageous when transporting a rider or vehicle from a deep water environment to a shallow water environment, e.g., a beach or a Master Blaster™.

The beginning and end of both straight turning corridor 36 and curved turning corridor 55 can be joined to known water attraction rides (e.g., a standard waterslide or flume ride) to serve as a continuation thereof and as an improvement thereto. Likewise, the beginning and end of straight turning corridor 36 and curved turning corridor 55 can also be joined to other embodiments of the invention disclosed herein.

Description of an Integrated Water Corridor System

Figure 5:
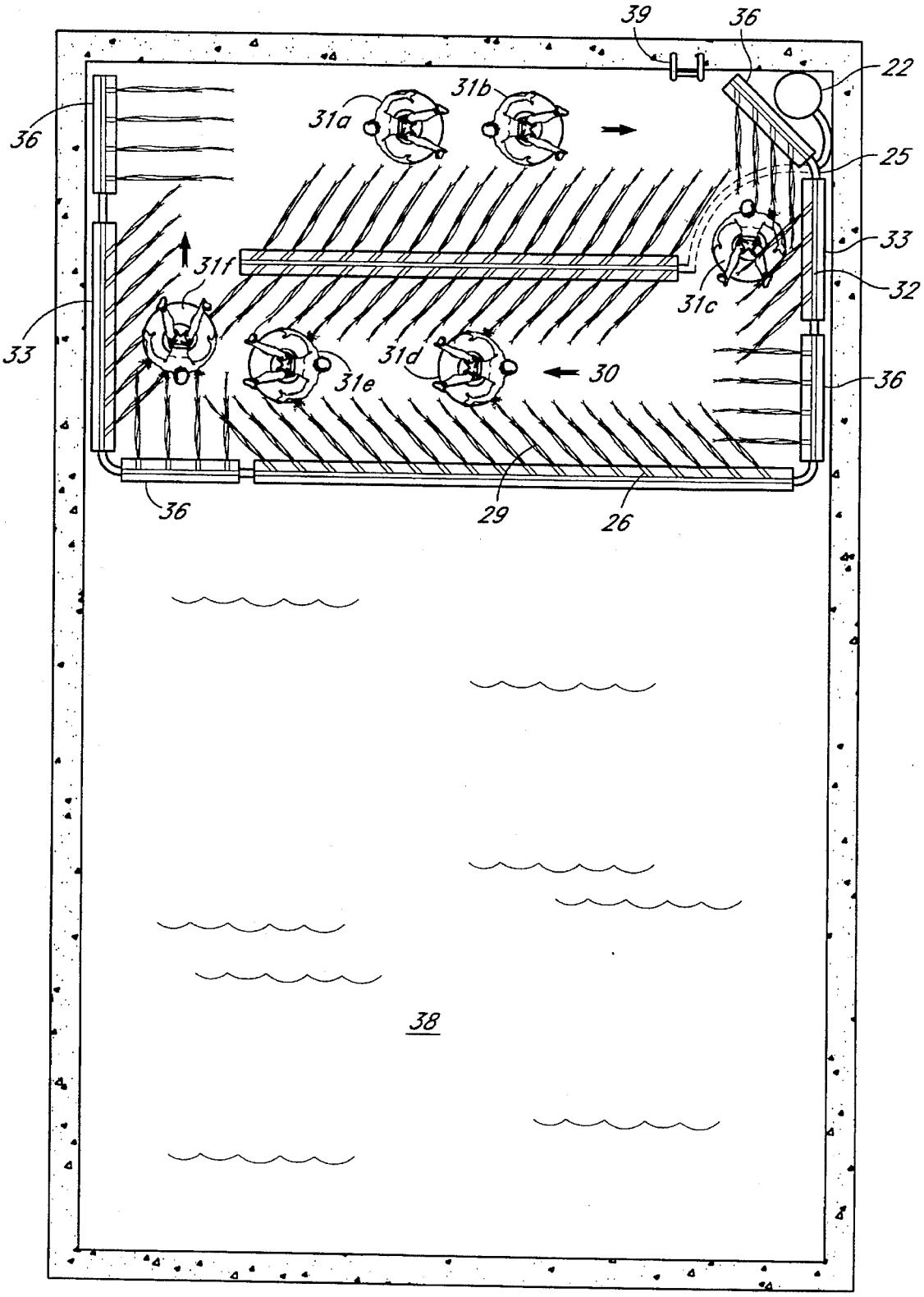
FIG. 5 is a top view of a swimming pool with an integrated water corridor system.

FIG. 5 depicts a plan view of a swimming pool 38 that is partially occupied by an integrated system of propulsion modules fashioned in a circuitous water corridor loop. A pump serves as water source 22, which connects by couple 25 (underwater couple is indicated by dashed line) to central pipe manifold 23 and serves to provide jetted water 29 through jet-forming nozzles 26, and thus powers the entire system. The distance between each connected module is a function of length of throw of jelled water 29 from nozzles 26. At a minimum, each connected module must be sufficiently close, and/or each jelled water discharge must be sufficiently powered to provide consecutive jetted water 29 overlap. With the addition of the proper combination of modules, the empty portion of the swimming pool, as pictured in FIG. 4, could be occupied by an expanded water corridor as operationally and financially desired.

Operation of an Integrated Water Corridor System

As illustrated in FIG. 5, riders enter and exit the integrated water corridor system by ladder 39. Jelled water discharge 29 originating from pumped water source 22 is already issuing from jet-forming nozzle 26 when riders 31*a*, 31*b*, 31*c*, 31*d*, 31*e*, and 31*f* enter the system. Since the velocity of jetted water discharge 29 is moving at a rate greater than the speed of the entering rider 31, a transfer of momentum from the higher-speed water to the lower-speed rider causes the rider to accelerate and approach the speed of the more rapidly moving water. Riders 31*a*, 31*b*, 31*c*, 31*d*, 31*e*, and 31*f* are propelled along this circuitous loop by combination of three parallel unilateral water corridors 33 (with indicator arrow pointing in the direction of desired movement in the corridor), a bilateral water corridor 30 (with indicator arrow pointing in the direction of the desired movement in the corridor), and four straight turning corridors 36. When riders encounter straight turning corridor 36, they change direction and are moved downstream into either parallel unilateral water corridor 33 or bilateral water corridor 30. Under either scenario, the water corridor proceeds to move the riders further along downstream into the next turning corridor. Jetted water 29 overlap permits riders 31*a*, 31*b*, 31*c*, 31*d*, 31*e*, and 31*f* to respectively transition in a safe and smooth manner from module to module and complete the circuitous loop. Although the integrated water corridor system shown in FIG. 5 is conductive for retrofitting to an existing swimming pool, improved methods of entry and exit are available using beaching corridor technology.

Analogous to the traditional lazy river there are numerous possibilities regarding the layout and design of the integrated water corridor system, as illustrated herein, including reconfiguring the ride layout; reconfiguring the length, width, and height of module 21; repositioning and recombination of jet-forming nozzles as functionally adjusted to the newly configured ride layout and profile; creating start and ending basins (as opposed to an endless loop); use of alternate riding vehicles and multiple riders; connecting to other rides or attractions; and adding special light, sound, and themeing effects. All such possibilities are subject to the design, construction, and operational guidelines as currently exist in the industry and as limited or expanded by the disclosures herein.

From the description above, a number of advantages of an integrated water corridor system become evident:

(a) Static/passive swimming pools and lakes can now be improved to include river-like flows as generated by a water corridor attraction. Furthermore, such water corridor attraction can be fashioned in an endless loop to provide increased duration of user enjoyment.

(b) Modular water corridor construction allows aquatic facility operators to size their system according to demand or budget.

Description of Beaching Corridor

Figure 6A:
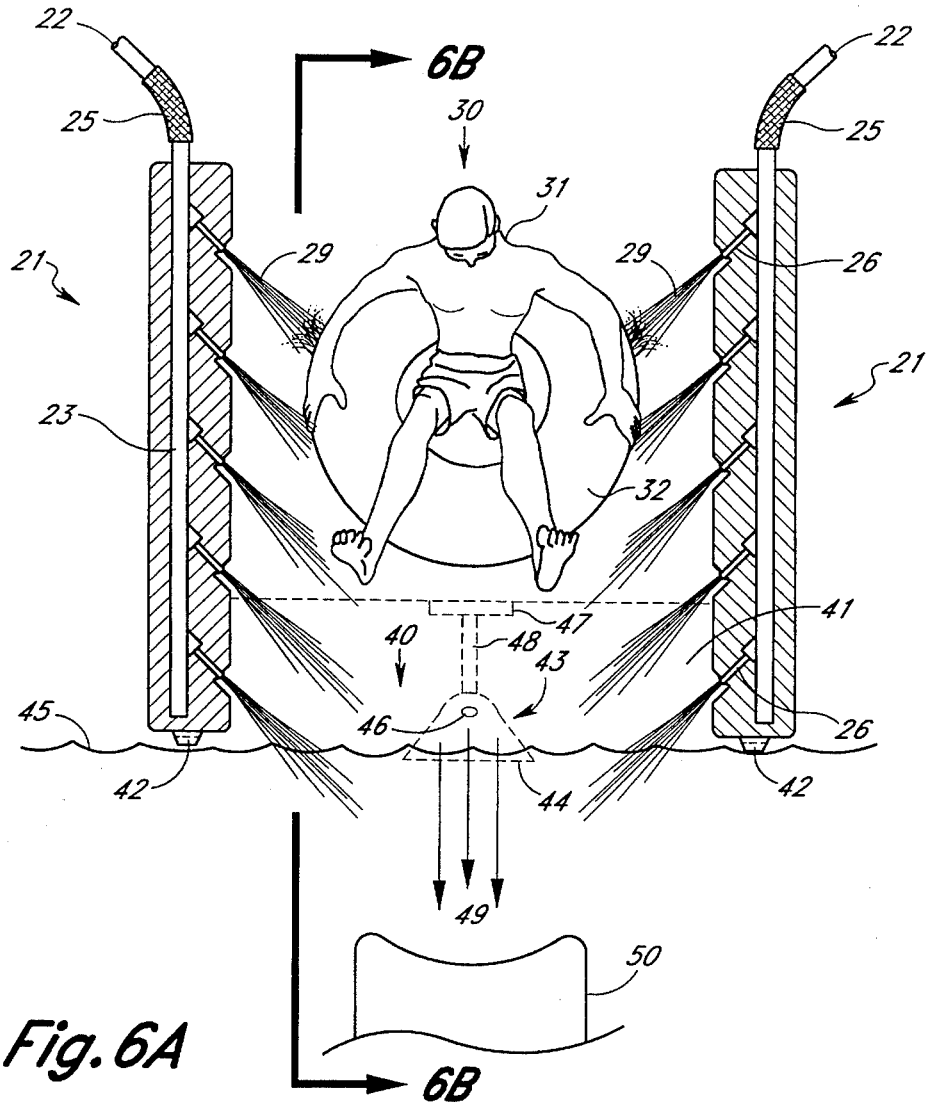
FIG. 6A is a top view of a beaching water corridor.
Figure 6B:
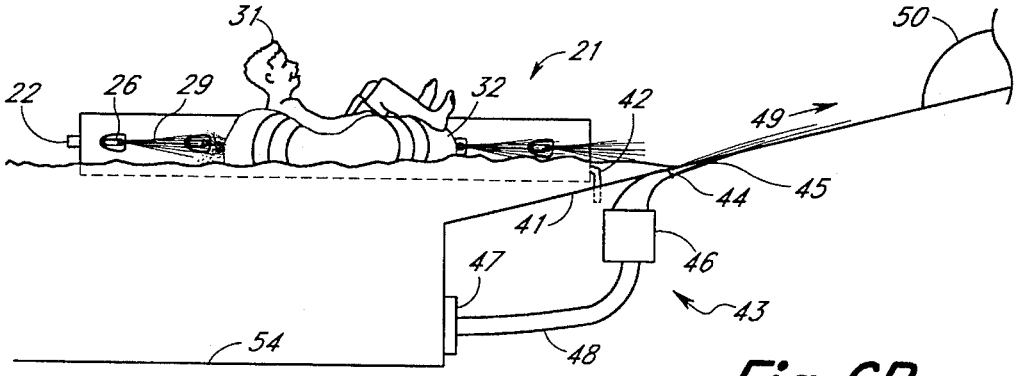
FIG. 6B is a side view of a beaching water corridor taken along 6B—6B of FIG. 6A.

FIG. 6A shows in plan view and FIG. 6B shows in cross section a beaching corridor 40 embodiment of the subject invention, comprised of bilateral water corridor 30 embodiment joined to a beach 41 by anchor 42 with central pipe manifold 23 oriented perpendicular to beach 41 and jetted water discharge 29 directed towards beach 41. As previously described, water corridor 30 is typically used in a deep-water environment; e.g., swimming pools, lakes, rivers, and the like. However, in certain applications it is advantageous to transition from a deep-water environment up onto a beach or shoreline and beyond. The beaching corridor embodiment achieves this desired result by water source 22 connected to central pipe manifold 23, providing high-pressure jetted water discharge 29 through jet-forming nozzles 26 to effect momentum transfer upon any floating object/participant/vessel propelled down the center of bilateral water corridor 30 and up onto beach 41. Although not illustrated, it is possible with proper alignment to substitute parallel unilateral water corridor 33, straight turning corridor 36, or curved turning corridor 55 for bilateral water corridor 30 to provide a means of moving the participant up to the beach 41.

To effect object/participant/vessel movement beyond beach 41, a Master Blaster™ injection mechanism 43 is positioned adjacent beach 41 with a blaster nozzle 44 positioned at or just beneath a beach water line 45. A blaster pump 46 draws water through a grate 47 and through a suction line 48 and injects a blast of water 49 (in the direction as indicated by arrow) up beach 41 and to a linked water attraction 50; e.g., waterslide, river ride, Master Blaster™, etc. If Master Blaster™ injection mechanism 43 is present, beach 41 should be comprised of a smooth, slick surface, e.g., coated concrete or fiberglass, to avoid erosion, minimize friction, and facilitate smooth transition to linked water attraction 50.

Operation of Beaching Corridor

The bilateral water corridor 30 component of beaching corridor 40 operates as previously discussed. Jelled water discharge 29 impacts either rider 31 or inner tube 32, resulting in momentum transfer, which drives rider 31 and inner tube 32 up onto beach 41.

Master Blaster™ injection mechanism 43 is positioned adjacent beach 41 with blaster nozzle 44 positioned at or just beneath water line 45 and issuing blast of water 49 further up the beach and into linked water attraction 50. Linked water attraction 50 can either be a conventional waterslide, Master Blaster™ injection mechanism, river ride, vortex pool, or any other attraction currently known to those schooled in the art.

From the description above, a number of advantages of beaching corridor 40 becomes evident:

(a) Movement of participants from a deep-water environment to shallow water and ultimately up onto dry land is now made possible by beaching corridor 40. This beaching process enhances attraction throughput capacity, as well as user enjoyment.

(b) Beaching corridor 40 advantageously allows participants to transfer by way of Master Blaster™ injection mechanism 43 into other water attractions at differing elevations without requiring the rider to exit their ride vehicle.

(c) Beaching corridor 40 will facilitate the exiting of handicapped from a deep-water environment.

Although the description above contains many specifications, these should not be construed as limiting the scope of the invention, but as merely providing illustrations of some of the presently preferred embodiments of this invention. For example, the module(s) which comprise the bilateral, unilateral parallel, turning, or beaching water corridors can have multiple arrays of modules instead of one; the integrated water corridor system can be shaped, proportioned, and profiled substantially different than illustrated, such as serpentine, circular, convoluted, etc.; a rider can enter the flow of water at an angle other than parallel to the line of flow; the flow of water could be cycled off/on at appropriate times to take advantage of the spacing that occurs between riders and effect a more efficient use of water flow.

What is claimed is:

1. A water injection conduit for propelling a rider or object floating on a body of water, comprising:

a propulsion module in communication with a pressurized water source, said propulsion module adapted to be positioned at or near the surface elevation of said body of water, said propulsion module having a jacket; so as to serve as a buoy or bumper;

and at least one waterjet located on said propulsion module for releasing a stream of jetted water, wherein said stream imparts momentum transfer to a rider or object floating on said body of water.

2. The water injection conduit of claim 1, wherein said jacket is constructed of a lightweight buoyant material of sufficient size and weight to allow said propulsion module to float on said body of water.

3. The water injection conduit of claim 1, wherein said propulsion module is connected to said water source by a coupling.

4. The water injection conduit of claim 1, wherein a control valve is provided to adjust the flow of water from said water source to said propulsion module.

5. The water injection conduit of claim 1, wherein a central pipe manifold is positioned within said propulsion module, and wherein a plurality of said waterjets are provided in communication with said central pipe manifold such that water under pressure from said water source travels through said central pipe manifold and through each of said water jets.

6. The water injection conduit of claim 1, wherein said water jet includes an adjustable nozzle for adjustably determining the flow of said stream of jetted water.

7. The water injection conduit of claim 1, wherein a tether is provided to secure said propulsion module at a predetermined position in said body of water.

8. The water injection conduit of claim 1, wherein a protective safety liner is provided such that a rider floating in said body of water by said conduit is protected from drowning.

9. The water injection conduit of claim 1, wherein a coupling is provided for securing said water injection conduit to an adjacent water injection conduit.

10. A water corridor for propelling a rider or object floating on a substantially deep body of water onto an adjacent substantially shallow body of water, said corridor comprising:

at least two water injection conduits forming bumpers or buoys connected to a water source under pressure, said water injection conduits comprising a central pipe manifold and a jacket for permitting said conduits to float on the surface of said deep body of water forming a corridor, said conduits adapted to be adjacent said shallow body of water such that a rider floating on said deep body of water can enter said corridor and exit directly onto said shallow body of water; and at least one waterjet positioned on each said water injection conduits, each of said waterjets releasing a stream of jetted water wherein said stream directs momentum transfer to said rider or object floating in said corridor such that said rider or object has sufficient velocity to exit said deep body of water and enter directly onto said shallow body of water.

11. The water corridor of claim 10, wherein said conduits are placed substantially parallel to one another such that said conduits form a corridor through which said rider or object may pass.

12. The water corridor of claim 10, wherein said corridor is elongated along a predetermined axis of elongation and wherein said water jets are provided at an angle of about 22 degrees relative to said axis of elongation.

13. The water corridor of claim 10, wherein said stream of jetted water adapted to contact a vessel so as to impart momentum transfer directly to the vessel.

14. The water corridor of claim 10, wherein an adjustment valve is provided to adjust a flow of water entering from said water source into said conduit.

15. The water corridor of claim 10, wherein each of said water jets is provided at a predetermined angle relative to said conduit.

16. The water corridor of claim 15, Wherein said water jets are positioned at a horizontal angle of about 22 degrees from the axis of said central pipe manifold.

17. The water corridor of claim 10, wherein additional pairs of conduits are positioned end to end and secured together by couplings such that said additional conduits form a substantially long corridor through which a rider or object may pass.

18. The water corridor of claim 10, wherein said water injection conduits are curved such that said corridor through which said rider or object may pass is curved.

19. A water ride for use in a swimming pool, said water ride comprising:

at least one water injection conduit connected to a water source under pressure, said water injection conduit having a buoyant material adapted to allow the conduit to float on the surface of a body of water contained in said swimming pool;

at least one injection nozzle located on said water injection conduit for injecting a flow of water in a predetermined direction relative to said conduit, said flow of water being adapted to impart momentum transfer to a rider or object floating on said body of water, said conduit adapted to be positioned relative to the sides of said swimming pool so as to form a corridor through which said rider or object may pass.

20. The water ride of claim 19, further comprising an additional water injection conduit which directs a flow of water at a second predetermined angle.

21. A water injection corridor for propelling a rider or object floating on a deep body of water, comprising:

at least one water injection conduit having a buoyant material adapted to allow the conduit to float on the surface of said body of water, said conduit being in communication with a water source under pressure; and at least one water injection nozzle positioned on said conduit, said water injection nozzle being adapted to release a stream of water in a predetermined direction and at a predetermined velocity so as to impinge upon said rider or object floating on said body of water causing said rider or object to move relative to said conduit.

22. The water injection corridor of claim 21, wherein a protective safety liner is provided underneath said conduit to prevent said rider from drowning within said body of water.

23. The water injection corridor of claim 21, wherein at least two of said conduits are positioned side by side parallel to one another at a distance sufficient to permit said rider or object to pass therebetween.

24. The water injection corridor of claim 21, wherein said conduit has a valve for controlling the rate of flow and pressure from said water source into said water conduit.

25. The water injection corridor of claim 21, wherein said conduit adapted to be removably secured at or near the surface level of said body of water such that said conduit can be moved to make room for other activities in said body of water.

26. The water injection corridor of claim 25, wherein said rate of flow of said stream of water is sufficient to accelerate said rider through a corridor formed by at least two of said conduits, wherein said rider enters said corridor at a first velocity and is accelerated to a second velocity through said corridor.

27. The water injection corridor of claim 26, wherein said direction of flow within said corridor is without regard to the direction of flow of said body of water.

28. The water injection corridor of claim 21, wherein said water corridor adapted to be positioned adjacent a substantially shallow body of water, wherein said water corridor provides a transport system whereby said rider can enter directly from said deep body of water and exit onto said adjacent shallow body of water.

29. The water injection corridor of claim 21, wherein said conduit adapted to be positioned relative to a retaining structure so as to form a corridor therebetween.

30. A water injection corridor for propelling a rider or object floating on a deep body of water, comprising:

at least one water injection conduit in communication with a water source under pressure and positioned adapted to be at or near the surface level of said body of water, said conduit being connected to a tether which secures said conduit in a predetermined position relative to said body of water; and at least one water injection nozzle positioned on said conduit, said water injection nozzle being adapted to release a stream of water in a predetermined direction and at a predetermined velocity, said stream of water being directed so as to impinge upon said rider or object floating on said body of water, causing said rider or object to move relative to said conduit.

31. A propulsion system for propelling a buoyant object or rider across the surface of a body of water, comprising:

a water injection conduit having a buoyant sleeve adapted to float at or near the surface level of said body of water and in communication with a pressurized water source, said conduit forming a corridor through which said buoyant object or rider may pass; and at least one nozzle disposed on said conduit adapted to release a stream of water, said nozzle having an outlet end disposed substantially above the surface level of said body of water and adapted to direct said stream of water to impinge upon said buoyant object or rider so as to transfer momentum to said buoyant object or rider causing it to be propelled across the surface of said body of water in a predetermined direction.

32. A method for propelling a buoyant object or rider across the surface of a deep body of water, comprising:

forming a corridor through which said buoyant object or rider may pass;

providing conduit having a plurality of laterally disposed water injection nozzles on said corridor floating at or above the surface level of said body of water; and supplying said nozzles with pressurized water causing said nozzles to release streams of water substantially above the surface level of said body of water so as to impinge upon said buoyant object or rider thereby transferring momentum to said buoyant object or rider and causing it to move through said corridor in a predetermined direction.

* * * * *